US012612765B2

(12) United States Patent
Rau et al.

(10) Patent No.: US 12,612,765 B2
(45) Date of Patent: Apr. 28, 2026

(54) HYDRAULIC FITTING ASSEMBLY FOR A CONSTRUCTION VEHICLE

(71) Applicant: CNH Industrial America LLC, New Holland, PA (US)

(72) Inventors: Paul Wilhelm Rau, Plain City, UT (US); Richard Lee Niespodzany, Pulaski, WI (US); Lonnie L. McGee, Jr., Burlington, IA (US)

(73) Assignee: CNH Industrial America LLC, New Holland, PA (US)

( * ) Notice: Subject to any disclaimer, the term of this patent is extended or adjusted under 35 U.S.C. 154(b) by 237 days.

(21) Appl. No.: 18/200,291

(22) Filed: May 22, 2023

(65) Prior Publication Data

US 2024/0392539 A1 Nov. 28, 2024

(51) Int. Cl.
*E02F 9/00* (2006.01)
*E02F 9/22* (2006.01)

(52) U.S. Cl.
CPC ..... *E02F 9/2275* (2013.01); *E02F 9/006* (2013.01)

(58) Field of Classification Search
CPC ..... E02F 9/006; E02F 9/2275; F16C 33/1045; F16C 11/045; F16C 2350/26; Y10T 403/32918; Y10T 403/32861; Y10T 403/32926; Y10T 137/5762; Y10T 137/87273; F16L 27/093; F16L 27/087; F16L 27/0828; F16L 27/0861
USPC ..... 137/615, 109, 110, 580, 599.02, 599.03; 251/355; 184/20, 6, 35; 285/119, 168, 285/190, 163, 94, 134, 273, 147.1–147.3, 285/276; 16/274; 92/119, 157; 403/36–39; 60/403
See application file for complete search history.

(56) References Cited

U.S. PATENT DOCUMENTS 386,881 A * 7/1888 Harris et al. ..... F16L 27/0845 285/190
422,017 A * 2/1890 Harris et al. ..... F16L 27/0861 285/190
673,280 A * 4/1901 Moran ..... F16L 27/0828 285/190
1,097,741 A * 5/1914 Voight ..... E05D 11/02 16/274
1,433,095 A * 10/1922 Peary ..... E05D 11/02 16/274
1,555,603 A * 9/1925 Overing, Jr. ..... F16C 11/045 411/513
2,002,781 A * 5/1935 Leighton ..... B60B 35/02 403/36
2,053,864 A * 9/1936 Cook ..... E05D 11/02 411/428

(Continued)

*Primary Examiner* — Craig J Price
(74) *Attorney, Agent, or Firm* — Dority & Manning, P.A.

(57) ABSTRACT

The present subject matter is directed to a work vehicle, such as a construction vehicle, including a first arm, a second arm pivotably coupled to the first arm, and a hydraulic fitting assembly coupled between the first arm and the second arm at a pivot joint and configured to lubricate the pivot joint. The hydraulic fitting assembly includes a first and second housing each defining a cavity configured to receive a hydraulic fluid therein. The cavity of each of the first and second housing are aligned. The first and second housings are each configured to rotate relative to one another when either the first arm or the second arm is pivoted. The lubrication applicator assembly defines a channel configured to receive a lubricant.

17 Claims, 5 Drawing Sheets

(56) References Cited

U.S. PATENT DOCUMENTS 2,083,970 A * 6/1937 Walter ..... F16L 27/093 285/190
2,179,931 A * 11/1939 Harris ..... E05D 5/10 16/274
2,307,328 A * 1/1943 Martin ..... F16L 27/093 285/190
2,400,658 A * 5/1946 Shepherd ..... F16L 27/093 285/190
2,459,643 A * 1/1949 Hartley ..... F16L 27/093 285/190
2,531,326 A * 11/1950 Di Paolo ..... B62D 17/00 403/36
2,570,942 A * 10/1951 Hadfield ..... E05D 11/02 16/274
2,826,438 A * 3/1958 Woodling ..... F16L 15/001 285/356
2,989,960 A * 6/1961 Hay ..... A61M 16/104 128/205.24
3,088,759 A * 5/1963 Corsette ..... F16L 27/093 285/190
3,098,662 A * 7/1963 Iversen ..... F16L 17/00 148/578
3,125,360 A * 3/1964 Ulrich ..... F16L 27/093 285/190
3,148,922 A * 9/1964 Roessler, Jr. ..... F16C 43/06 285/276
3,166,252 A * 1/1965 Williams ..... B05B 9/01 285/190
3,210,099 A * 10/1965 Franck ..... F16L 27/093 285/190
3,219,366 A * 11/1965 Franck ..... F16L 41/005 285/190
3,244,439 A * 4/1966 Montesi ..... F16L 33/223 285/190
3,384,394 A * 5/1968 O'connor ..... F16L 27/093 285/190
3,402,253 A * 9/1968 Mccracken ..... H01R 39/00 285/190
3,411,526 A * 11/1968 Schaefer ..... F16L 39/04 285/190
3,967,838 A * 7/1976 Legris ..... F16L 41/08 285/190
4,270,286 A * 6/1981 Mieger ..... E02F 3/96 251/339
4,362,324 A * 12/1982 Kelly ..... F16L 27/087 29/523
4,437,690 A * 3/1984 Drath ..... F16L 27/0837 285/280
4,485,654 A * 12/1984 Rasmussen ..... G01M 3/022 72/58
4,655,398 A * 4/1987 Liggett ..... B05B 13/06 239/587.2
4,679,285 A * 7/1987 Ballantyne ..... E05D 11/02 29/523
4,702,276 A * 10/1987 Bouteille ..... F15B 15/149 251/149.6
4,791,961 A * 12/1988 Nitzberg ..... F16L 55/1015 137/614.04
4,823,835 A * 4/1989 Chu ..... F16K 27/0281 137/557
4,955,643 A * 9/1990 Bona ..... F16L 41/005 285/190
4,976,282 A * 12/1990 Kubala ..... F16L 27/0828 285/98
D317,818 S * 6/1991 Huber ..... D23/264
5,188,146 A * 2/1993 Cook, Jr. ..... A01K 73/06 137/580
5,372,389 A * 12/1994 Tam ..... F16L 27/093 285/190
5,533,764 A * 7/1996 Williamson ..... F16L 41/005 285/190
5,607,189 A * 3/1997 Howeth ..... F16L 27/093 285/190
5,636,877 A * 6/1997 Purvis ..... F16L 41/005 285/190
5,702,130 A * 12/1997 Jostein ..... F16L 39/06 285/121.6
5,718,458 A * 2/1998 Erstad ..... F16L 39/06 285/422
5,771,538 A * 6/1998 Huppert, Sr. ..... E05D 11/02 16/386
5,803,360 A * 9/1998 Spitznagel ..... B05B 7/2402 285/190
5,839,764 A * 11/1998 Heidelberger ..... F16L 27/093 285/190
6,007,109 A * 12/1999 Schoetz ..... F16L 41/005 285/190
6,042,295 A * 3/2000 Barden ..... F16C 11/045 403/150
6,056,325 A * 5/2000 Bernard ..... F16L 27/093 285/190
6,070,917 A * 6/2000 Wiebe ..... F16L 27/0845 285/190
6,325,686 B1 * 12/2001 Funami ..... B63H 20/10 440/61 R
6,360,742 B1 * 3/2002 Maxwell ..... A62B 9/04 128/205.22
6,425,730 B1 * 7/2002 Kaczmarski ..... E02F 3/3609 37/468
6,578,603 B1 * 6/2003 Ødegaard ..... F16L 39/06 285/190
6,929,099 B2 8/2005 Jakob et al.
6,976,644 B2 * 12/2005 Troudt ..... B05B 15/652 239/587.5
7,275,475 B2 10/2007 Deschamps et al.
7,681,591 B2 * 3/2010 Lundman ..... F16K 7/10 285/190
7,703,814 B2 * 4/2010 Wei ..... F16L 27/093 285/190
8,292,332 B2 * 10/2012 Mitchell ..... F16L 27/093 285/190
9,393,860 B2 * 7/2016 Vidal ..... B60K 17/14
9,568,132 B2 * 2/2017 Erickson ..... E03C 1/04
9,649,898 B2 * 5/2017 Scott ..... B60C 29/06
10,132,352 B2 * 11/2018 Tormen ..... E02F 9/006
10,161,424 B2 * 12/2018 Bohner ..... F15B 13/022
10,392,058 B2 * 8/2019 Bradley ..... B62D 55/092
10,473,252 B2 * 11/2019 Oberdorfer ..... F16L 53/32
11,365,526 B2 * 6/2022 Kaatrasalo ..... E02F 3/3681
11,459,727 B2 * 10/2022 Strashny ..... F16C 33/1055
11,590,956 B2 * 2/2023 Gumiero ..... B60T 17/043
11,603,642 B2 * 3/2023 Tissier ..... E02F 3/765
11,692,657 B2 * 7/2023 Clifford ..... F16L 27/087 137/615
12,404,958 B2 * 9/2025 Ikeno ..... F16L 27/087
12,454,979 B2 * 10/2025 Ellis ..... F16C 33/1025
2008/0003092 A1 * 1/2008 Baclija ..... B25J 19/0029 414/752.1
2008/0083844 A1 * 4/2008 Leber ..... E03C 1/06 239/600
2008/0238092 A1 * 10/2008 Chen ..... B25C 1/04 285/190
2010/0158601 A1 * 6/2010 Salas Madrid ..... E02F 9/006 403/38
2012/0306195 A1 12/2012 Fowkes et al.
2015/0053450 A1 * 2/2015 Van Gemert ..... E02F 9/006 173/218
2022/0136208 A1 * 5/2022 Okada ..... E02F 9/121 285/93

* cited by examiner

HYDRAULIC FITTING ASSEMBLY FOR A CONSTRUCTION VEHICLE

FIELD OF THE INVENTION

The present disclosure generally relates to work vehicles, such as construction vehicles, and, more particularly, to hydraulic fitting assemblies for construction vehicles.

BACKGROUND OF THE INVENTION

A wide variety of work vehicles, such as construction vehicles, have been developed for various purposes. Certain construction vehicles may include a backhoe or excavator for transporting large, loose, and/or awkward material. For instance, a tractor-loader-backhoe or an excavator may be used to remove large amounts of material such as gravel, dirt, or similar substances. These construction vehicles commonly include lift arm assemblies, such as hydraulically operated lift arm assemblies, coupled to an attachment tool, such as a bucket or claw, to move the attachment tool to a desired location during earthmoving operations. The lift arm assemblies commonly include a boom arm and a dipper arm pivotably coupled to the boom arm at a pivot joint.

Furthermore, construction vehicles commonly include hydraulic tubes or hoses. For example, a boom arm of a construction vehicle commonly includes a hydraulic tube or hose that provides hydraulic fluid to an actuator that moves the boom arm. Likewise, a dipper arm of the construction vehicle is pivotably coupled to the boom arm at a pivot joint is commonly coupled to a separate hydraulic tube or hose that provides hydraulic fluid to a separate actuator that moves the dipper arm. The hydraulic tube or hose coupled to the boom arm is often connected to the hydraulic tube or hose coupled to the dipper arm at the pivot joint. To allow for relative movement between the boom arm and the dipper arm at the pivot joint, the hydraulic tubes or hoses on the boom arm and the dipper arm are typically coupled together via flexible tubes or hoses. These flexible hoses can, in turn, bend without disruption of hydraulic fluid flow to the boom arm and dipper arm during operation of the lift arm assembly. However, these flexible hoses are prone to interference with the lift arm assemblies and/or wearing during operation of lift arm assemblies.

Accordingly, an improved hydraulic fitting assembly for a construction vehicle would be welcomed in the technology.

SUMMARY OF THE INVENTION

Aspects and advantages of the technology will be set forth in part in the following description, or may be obvious from the description, or may be learned through practice of the technology.

In one aspect, the present subject matter is directed to a work vehicle. The work vehicle includes a first arm and a second arm pivotably coupled to the first arm. The work vehicle also includes a hydraulic fitting assembly coupled between the first arm and the second arm at a pivot joint. Furthermore, the hydraulic fitting assembly includes a first housing defining a cavity configured to receive a hydraulic fluid therein. The first housing is configured to rotate relative to a second housing when at least one of the first arm or the second arm is pivoted. Additionally, the hydraulic fitting assembly includes the second housing rotatably coupled to the first housing such that the second housing is configured to rotate relative to the first housing when at least one of the first arm or the second arm is pivoted. The second housing defines a cavity configured to receive the hydraulic fluid therein, and the cavity of the second housing is aligned with the cavity of the first housing. Moreover, the hydraulic fitting assembly includes a lubrication applicator assembly at least partially positioned within the cavity of the first housing and the cavity of the second housing. The lubrication applicator assembly defines a channel therein configured to receive a lubricant. As such, the hydraulic fitting assembly is configured to lubricate the pivot joint.

In another aspect, the present subject matter is directed to a system for lubricating a pivot joint of a lift arm assembly of a work vehicle. The system includes a first arm and a second arm pivotably coupled to the first arm. The system also includes a hydraulic fitting assembly coupled between the first arm and the second arm at a pivot joint. Furthermore, the hydraulic fitting assembly includes a first housing defining a cavity configured to receive a hydraulic fluid therein. The first housing is configured to rotate relative to a second housing when at least one of the first arm or the second arm is pivoted. Additionally, the hydraulic fitting assembly includes the second housing rotatably coupled to the first housing such that the second housing is configured to rotate relative to the first housing when at least one of the first arm or the second arm is pivoted. The second housing defines a cavity configured to receive the hydraulic fluid therein, and the cavity of the second housing is aligned with the cavity of the first housing. Moreover, the hydraulic fitting assembly includes a lubrication applicator assembly at least partially positioned within the cavity of the first housing and the cavity of the second housing. The lubrication applicator assembly defines a channel therein configured to receive a lubricant. As such, the hydraulic fitting assembly is configured to lubricate the pivot joint.

In another aspect, the present subject matter is directed to a construction vehicle. The construction vehicle includes a frame and a lift arm assembly. The lift arm assembly includes a first arm pivotably coupled to the frame at a first pivot joint, and a second arm pivotably coupled to the first arm at a second pivot joint. Additionally, the construction vehicle includes a hydraulic fitting assembly coupled to the second pivot joint. The hydraulic fitting assembly includes a first housing defining a cavity configured to receive a hydraulic fluid therein. The first housing is configured to rotate relative to a second housing when at least one of the first arm or the second arm is pivoted. Additionally, the hydraulic fitting assembly includes the second housing rotatably coupled to the first housing such that the second housing is configured to rotate relative to the first housing when at least one of the first arm or the second arm is pivoted. The second housing defines a cavity configured to receive the hydraulic fluid therein, and the cavity of the second housing is aligned with the cavity of the first housing. Moreover, the hydraulic fitting assembly includes a lubrication applicator assembly at least partially positioned within the cavity of the first housing and the cavity of the second housing. The lubrication applicator assembly defines a channel therein configured to receive a lubricant. As such, the hydraulic fitting assembly is configured to lubricate the pivot joint.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended figures, in which.

Figure 1:
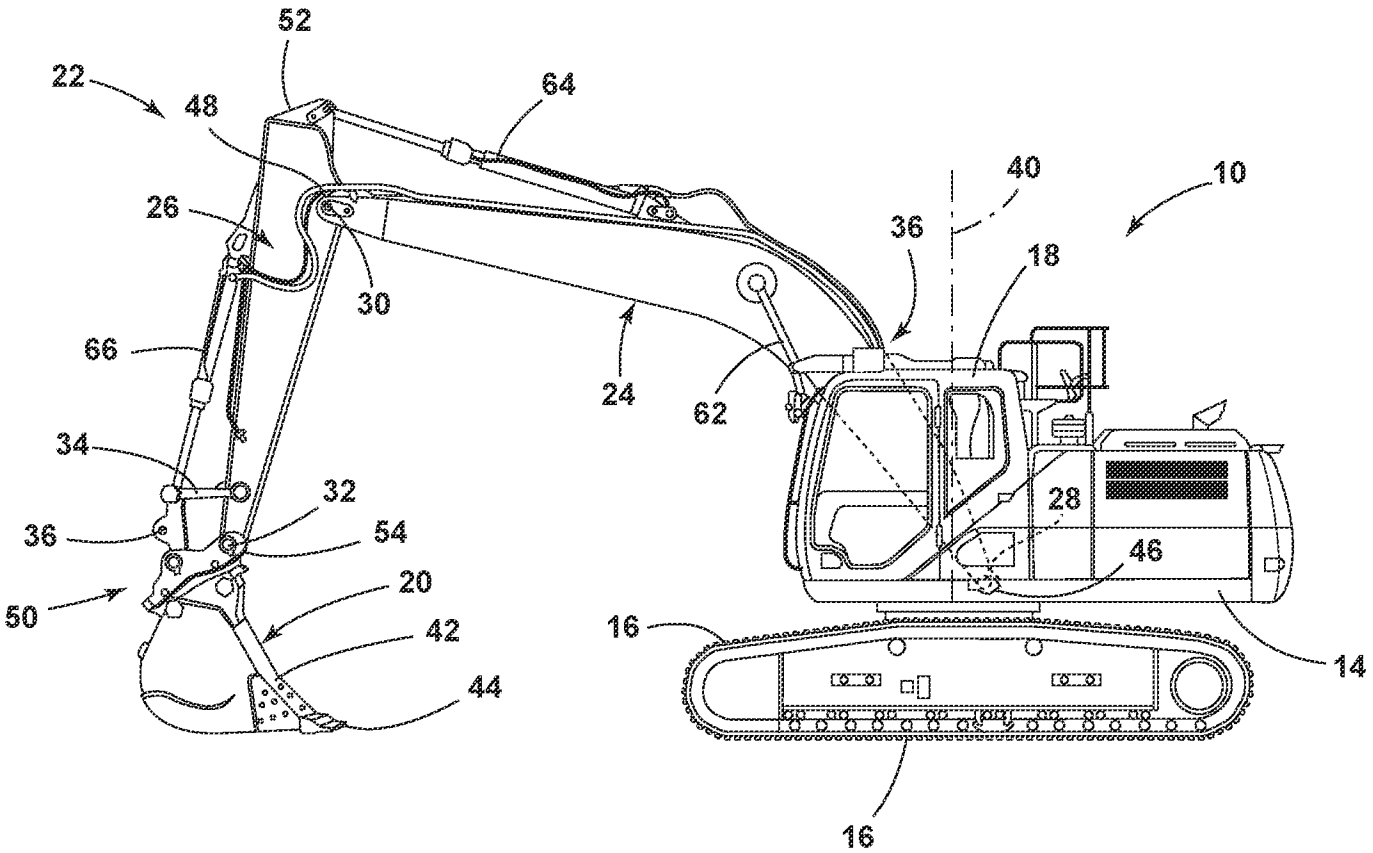
FIG. 1 illustrates a side view of one embodiment of a work vehicle in accordance with aspects of the present subject matter.

Repeat use of reference characters in the present specification and drawings is intended to represent the same or analogous features or elements of the present technology.

DETAILED DESCRIPTION OF THE DRAWINGS

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to a hydraulic fitting assembly for a work vehicle. As will be described below, the work vehicle includes a first arm and a second arm pivotably coupled to the first arm. For example, the first arm may be configured as a boom arm and the second arm may be configured as a dipper arm pivotably coupled to the boom arm.

The hydraulic fitting assembly may be coupled between the first arm and the second arm at a pivot joint. The hydraulic fitting assembly may also be coupled to a first hydraulic tube and a second hydraulic tube, which may be rigid hydraulic tubes. Additionally, the hydraulic fitting assembly includes a first housing and a second housing each defining a cavity configured to receive a hydraulic fluid therein. For example, in some embodiments, the first housing includes a first tube fitting corresponding to an inlet configured to receive the hydraulic fluid from the first hydraulic tube. Likewise, the second housing includes a second tube fitting corresponding to an outlet configured to discharge the hydraulic fluid from the second hydraulic tube. Moreover, the cavity of the first housing and the cavity of the second housing may be aligned with each other.

Furthermore, the first housing and the second housing are each configured to rotate relative to each other when either the first arm or the second arm of the work vehicle is pivoted. For example, in some embodiments, the first hydraulic tube is fixed relative to the first arm such that the first hydraulic tube rotates with the first housing and the first arm when the first arm is pivoted relative to the second arm. Likewise, in some embodiments, the second hydraulic tube is fixed relative to the second arm such that the second hydraulic tube rotates with the second housing and the second arm when the second arm is pivoted relative to the first arm.

Moreover, the hydraulic fitting assembly includes a lubrication applicator assembly defining a channel therein configured to receive a lubricant. The lubrication applicator may be at least partially positioned within the cavity of the first housing and the cavity of the second housing. As such, the hydraulic fitting assembly is configured to lubricate the pivot joint.

The disclosed hydraulic fitting assembly improves work vehicle operation. More specifically, construction vehicles commonly include arms or other components that pivot relative to each other. For example, some construction vehicles include a boom arm and a dipper arm pivotably coupled to the boom arm at a pivot joint. Construction vehicles also commonly utilize hydraulic tubes or hoses that provide hydraulic fluid to actuators that move components of the construction vehicle that pivot relative to each other. These hydraulic tubes or hoses are commonly routed from a hydraulic fluid source along the pivotable components, such as the dipper arm and the boom arm, adjacent to the pivot joints. Hydraulic tubes or hoses are often flexible tubes or hoses prone to interference with the pivotable components and/or unwanted deformation. Additionally, pivot joints need to be lubricated to prevent unnecessary friction between the pivotable components. As such, the disclosed construction vehicle includes a hydraulic fitting assembly with first and second housings that are rotatable during operation of the lift arm assembly, which allows use of rigid hydraulic tubes that are less prone to interference with pivotable components. Furthermore, the hydraulic fitting assembly includes the lubrication applicator assembly configured to lubricate a pivot joint. As such, when components at a pivot joint, such as the boom arm and the dipper arm, move relative to each other, the lubrication minimizes heat and friction between the moving components.

Referring now to drawings, FIG. 1 illustrates a side view of one embodiment of a work vehicle 10 in accordance with aspect of the present subject matter. As shown in the illustrated embodiment, the work vehicle 10 is configured as a construction vehicle, such as the illustrated excavator. However, in other embodiments, the work vehicle 10 may be configured as any other suitable construction vehicle (e.g., a loader, shovel, bulldozer, etc.), an agricultural vehicle, and/or the like.

As shown in FIG. 1, the work vehicle 10 includes a frame or chassis 14 coupled to and supported by a pair of tracks 16 for movement across a worksite. However, in other embodiments, the frame 14 may be supported in any other suitable manner, such as via wheels, a combination of wheels and tracks, or a fixed platform. In some embodiments, an operator's cab 18 may be supported by a portion of the frame 14 and may house a user interface (not shown) including various input devices for permitting an operator to control the operation of one or more components of the work vehicle 10. However, it should be appreciated that, in some embodiments, one or more components of the user interface (not shown) may be positioned remotely from the work vehicle 10. The frame 14 may, in some embodiments, be configured such that the operator's cab 18 is pivotable about a chassis axis 40.

Additionally, the work vehicle 10 includes an attachment tool 20 articulable relative to the frame 14 in several embodiments. The frame 14 may, in some embodiments, be configured such that the attachment tool 20 is pivotable about a chassis axis 40. In one embodiment, the attachment tool 20 may be configured as a bucket defining a cavity 42 and having a plurality of teeth 44 positioned thereon. The teeth 44, in turn, can be used to break up worksite materials (e.g., gravel, concrete, etc.) for collection within the cavity 42. However, in other embodiments, the attachment tool 20 may be configured as any other suitable tool, such as a claw, and/or the like.

Furthermore, the work vehicle 10 includes a lift arm assembly 22 coupled thereto. In general, the lift arm assembly 22 supports the attachment tool 20 relative to the frame 14. Specifically, in several embodiments, the lift arm assembly 22 includes a boom arm 24, a dipper arm 26, a driving link 34, and a driven link 36. The boom arm 24, in turn, extends between a first end 46 and a second end 48. Similarly, the dipper arm 26 extends between a first end 52 and a second end 54. The first end 46 of the boom arm 24 is pivotably coupled to the frame 14 of the work vehicle 10 about a first pivot axis 28 at a first pivot joint 32. Similarly, the first end 52 of the dipper arm 26 is pivotable coupled to the second end 48 of the boom arm 24 about a second pivot axis 30 at a second pivot joint 38. The driving link 34 is pivotably coupled to the second end 54 of the dipper arm 26. The driven link 36 is pivotably coupled to the driving link 34. However, in alternative embodiments, the lift arm assembly 22 may be configured in any other suitable manner.

Moreover, the work vehicle 10 includes a coupling assembly 50 configured to pivotably couple the attachment tool 20 to the lift arm assembly 22 of the work vehicle 10. For example, as shown in FIG. 1, the coupling assembly 50 is pivotably coupled to the second end 54 of the dipper arm 26, pivotably coupled to the driven link 36, and fixedly coupled to the attachment tool 20 such that the attachment tool 20 is pivotable relative to the dipper arm 26. However, in alternative embodiments, the attachment tool 20 may be coupled to the lift arm assembly 22 in any other suitable manner.

Furthermore, in several embodiments, the lift arm assembly 22 further includes a plurality of hydraulic cylinders for actuating components 20, 24, 26 of the lift arm assembly 22. For instance, a first hydraulic cylinder 62 may be coupled between the boom arm 24 and the frame 14 for pivoting the boom arm 24 relative to the frame 14. Similarly, a second hydraulic cylinder 64 may be coupled between the boom arm 24 and the dipper arm 26 for pivoting the dipper arm 26 relative to the boom arm 24. Further, a third hydraulic cylinder 66 may be coupled between the dipper arm 26 and the driving link 34 for pivoting the attachment tool 20 relative to the dipper arm 26. By selectively pivoting the components 20, 24, 26 of the lift arm assembly 22, the attachment tool 20 may perform various operations within a worksite.

Moreover, the work vehicle 10 includes a hydraulic fitting assembly 58 (FIG. 2) to the lift arm assembly 22, such as between the boom arm 24 and the dipper arm 26 at a pivot joint. In some embodiments, the hydraulic fitting assembly 58 (FIG. 2) may be coupled to the lift arm assembly 22 at the second pivot joint 38 and configured to lubricate the second pivot joint 38. However, it should be appreciated that the hydraulic fitting assembly 58 (FIG. 2) may be coupled at any other suitable location, such as at the first pivot joint 32. The hydraulic fitting assembly 58 will be discussed in detail below with reference to FIGS. 2-5B.

Additionally, as will be described below, one or more hydraulic tubes may be coupled to the hydraulic fitting assembly 58 and configured to convey hydraulic fluid between the hydraulics tubes and the hydraulic fitting assembly 58. The hydraulic cylinders 62, 64, 66 may be associated with the hydraulic tubes such that the hydraulic cylinders 62, 64, 66 receive the hydraulic fluid from the hydraulic tubes.

It should be appreciated that the configuration of the work vehicle 10 described above and shown in FIG. 1 is provided only to place the present subject matter in an exemplary field of use. Thus, it should be appreciated that the present subject matter may be readily adaptable to any manner of work vehicle configuration. For example, in an alternative embodiment, the work vehicle 10 may further include any other tools, implements, and/or components appropriate for use with a work vehicle 10.

Figure 2:
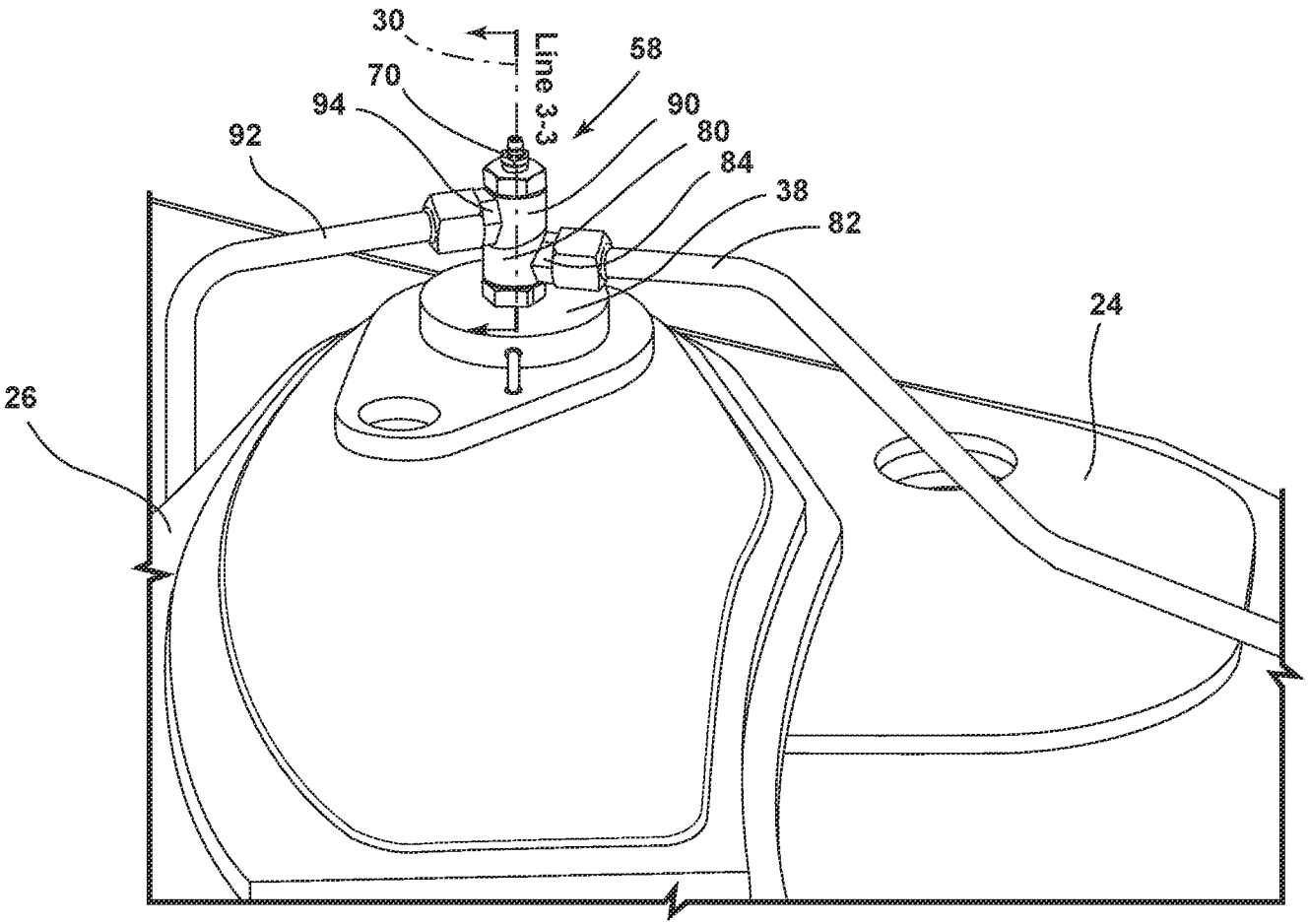
FIG. 2 illustrates a perspective view of one embodiment of a hydraulic fitting assembly for a work vehicle in accordance with aspects of the present subject matter.

Referring now to FIG. 2, a perspective view of one embodiment of a hydraulic fitting assembly 58 for a work vehicle is illustrated. In general, the hydraulic fitting assembly 58 will be described herein with reference to the work vehicle 10 described above with reference to FIG. 1. However, it should be appreciated by those of ordinary skill in the art that the hydraulic fitting assembly 58 may generally be utilized with a work vehicle 10 having any other suitable configuration, such as a construction vehicle or otherwise.

In particular, FIG. 2 shows the hydraulic fitting assembly 58 coupled to a second pivot joint of a lift arm assembly 22 of the work vehicle 10 illustrated in FIG. 1. However, it should be appreciated that the hydraulic fitting assembly 58 may be coupled to any suitable pivot joint of the work vehicle 10 or any other suitable work vehicle.

As shown in FIG. 2, the work vehicle 10 includes a first hydraulic tube 82 and a second hydraulic tube 92. The first hydraulic tube 82 may be coupled to the boom arm 24 and the second hydraulic tube 92 may be coupled to the dipper arm 26. Additionally, as will be described below, the first hydraulic tube 82 and the second hydraulic tube 92 are coupled together via the hydraulic fitting assembly 58, which allows fluid flow between the first hydraulic tube 82 and the second hydraulic tube 92 to be maintained as the dipper arm 26 and the boom arm 24 move relative to each other.

Moreover, the first hydraulic tube 82 and the second hydraulic tube 92 may each be configured as rigid hydraulic tubes (e.g., minimally deformable/bendable tube). As such, the first hydraulic tube 82 and the second hydraulic tube 92 may each be manufactured from such materials as steel or aluminum, etc. However, it should be appreciated that the first hydraulic tube 82 and the second hydraulic tube 92 may be manufactured from any other suitable material such that the first hydraulic tube 82 and the second hydraulic tube 92 may be configured as rigid hydraulic tubes. Furthermore, it should be appreciated that the first hydraulic tube 82 and the second hydraulic tube 92 may each be configured as any other suitable type of hydraulic tube, such as a flexible hydraulic tube (e.g., maximally deformable/bendable tube). As such, the first hydraulic tube 82 and the second hydraulic tube 92 may each be manufactured from elastomeric materials or other materials such as bendable steel materials.

Additionally, as shown in FIG. 2, the hydraulic fitting assembly 58 includes a first housing 80. The first housing 80 is configured to receive a hydraulic fluid therein. The first housing 80 is configured to rotate relative to a second housing 90 of the hydraulic fitting assembly 58 when the boom arm 24 and/or the dipper arm 26 is pivoted. The first housing 80 is rotatably coupled to a lubrication applicator assembly 70 such that the first housing 80 is configured to rotate about the second pivot axis 30 relative to the second housing 90 when the boom arm 24 and/or the dipper arm 26 is pivoted. For example, the first housing 80 may rotate about the second pivot axis 30 relative to the second housing 90 in a first direction (e.g., clockwise direction) or a second direction (e.g., counterclockwise direction) when the boom arm 24 and/or the dipper arm 26 is pivoted. The first housing 80 will be described in more detail below in reference to FIG. 3.

Likewise, as shown in FIG. 2, the hydraulic fitting assembly 58 includes the second housing 90. The second housing 90 is configured to receive the hydraulic fluid therein. The second housing 90 is configured to rotate relative to the first housing 80 when the boom arm 24 and/or the dipper arm 26 is pivoted. The second housing 90 is rotatably coupled to the lubrication applicator assembly 70 such that the second housing 90 is configured to rotate about the second pivot axis 30 relative to the first housing 80 when the boom arm 24 and/or the dipper arm 26 is pivoted. For example, the second housing 90 may rotate about the second pivot axis 30 relative the first housing 80 in the first direction (e.g., clockwise direction) or the second direction (e.g., counterclockwise direction) when the boom arm 24 and/or the dipper arm 26 is pivoted. The second housing 90 will be described in more detail below in reference to FIG. 3.

Furthermore, in some embodiments, the first housing 80 of the hydraulic fitting assembly 58 is coupled to the first hydraulic tube 82. For example, the first housing 80 may include a first tube fitting 84 coupled thereto and extending outward therefrom and configured to couple a hydraulic tube, such as the first hydraulic tube 82, to the first housing 80. The first tube fitting 84 may be configured to be removable (e.g., unfastened) from the first housing 80. As such, various tube fittings configured to couple hydraulic tubes with various diameters to the first housing 80 may be coupled (e.g., fastened) to the first housing 80.

Likewise, in some embodiments, the second housing 90 of the hydraulic fitting assembly 58 is coupled to the second hydraulic tube 92. For example, the second housing 90 may include a second tube fitting 94 coupled thereto and extending outward therefrom and configured to couple a hydraulic tube, such as the second hydraulic tube 92, to the second housing 90. The second tube fitting 94 may be configured to be removable (e.g., unfastened) from the second housing 90. As such, various tube fittings configured to couple hydraulic tubes with various diameters to the second housing 90 may be coupled (e.g., fastened) to the second housing 90.

Moreover, the second hydraulic tube 92 may be configured to convey a hydraulic fluid between the hydraulic fitting assembly 58 and the second hydraulic tube 92. For example, the second hydraulic tube 92 may be configured to convey the hydraulic fluid from the second housing 90 to one or more hydraulic fluid destinations (e.g., the attachment tool 20). Additionally, the second tube fitting 94 may also correspond to an outlet of the second housing 90 configured to discharge the hydraulic fluid from the second housing 90.

Furthermore, as shown in FIG. 2, the first hydraulic tube 82 is fixed relative to the boom arm 24. As such, the first hydraulic tube 82 moves with the boom arm 24. In this respect, the first hydraulic tube 82 is configured to rotate the first housing 80 about the second pivot axis 30 relative to the second housing 90 when the boom arm 24 of the lift arm assembly 22 is pivoted about the first pivot axis 28 relative to the frame 14 at the first pivot joint 32 by the first hydraulic cylinder 62 (FIG. 1). For example, the first hydraulic tube 82 may rotate the first housing 80 about the second pivot axis 30 relative to the second housing 90 in the first direction (e.g., clockwise direction) or the second direction (e.g., counterclockwise direction) when the boom arm 24 of the lift arm assembly 22 is pivoted about the first pivot axis 28 relative to the frame 14.

Likewise, as shown in FIG. 2, the second hydraulic tube 92 is fixed relative to the dipper arm 26. As such, the second hydraulic tube 92 moves with the dipper arm 26. In this respect, the second hydraulic tube 92 is configured to rotate the second housing 90 about the second pivot axis 30 relative to the first housing 80 when the dipper arm 26 of the lift arm assembly 22 is pivoted about the second pivot axis 30 relative to the boom arm 24 at the second pivot joint 38 by the second hydraulic cylinder 64 (FIG. 1). For example, the second hydraulic tube 92 may rotate the second housing 90 about the second pivot axis 30 relative to the first housing 80 in the first direction (e.g., clockwise direction) or the second direction (e.g., counterclockwise direction) when the dipper arm 26 of the lift arm assembly 22 is pivoted about the second pivot axis 30 relative to the boom arm 24.

Furthermore, as shown in FIG. 2, the hydraulic fitting assembly 58 includes the lubrication applicator assembly 70 configured to receive a lubricant. The lubrication applicator assembly 70 is also configured to lubricate, with the lubricant, a pivot joint between moving components to prevent unnecessary friction between components. For example, in the illustrated embodiment, the lubrication applicator assembly 70, and thus the hydraulic fitting assembly 58, is configured to lubricate the second pivot joint 38 to prevent unnecessary friction between interacting components of the dipper arm 26 and the boom arm 24, particularly when the dipper arm 26 is pivoting about the second pivot axis 30 relative to the boom arm 24 at the second pivot joint 38. However, it should be appreciated that the lubrication applicator assembly 70 may be configured to lubricate any other suitable component of the work vehicle 10, such as the first pivot joint 32.

Additionally, the lubrication applicator assembly 70 is at least partially positioned within the first housing 80 and the second housing 90. As such, the first housing 80 and the second housing 90 are rotatably coupled to the lubrication applicator assembly.

Moreover, the lubrication applicator assembly 70 may be configured to couple the hydraulic fitting assembly 58 to the second pivot joint 38. For example, in the illustrated embodiment, the second pivot joint 38 may define a pivot joint lubrication channel within which an end of the lubrication applicator assembly 70, and thus the lubricant to lubricate the second pivot joint 38, is received. The lubrication applicator assembly 70 will be described in more detail below in reference to FIG. 3.

Figure 3:
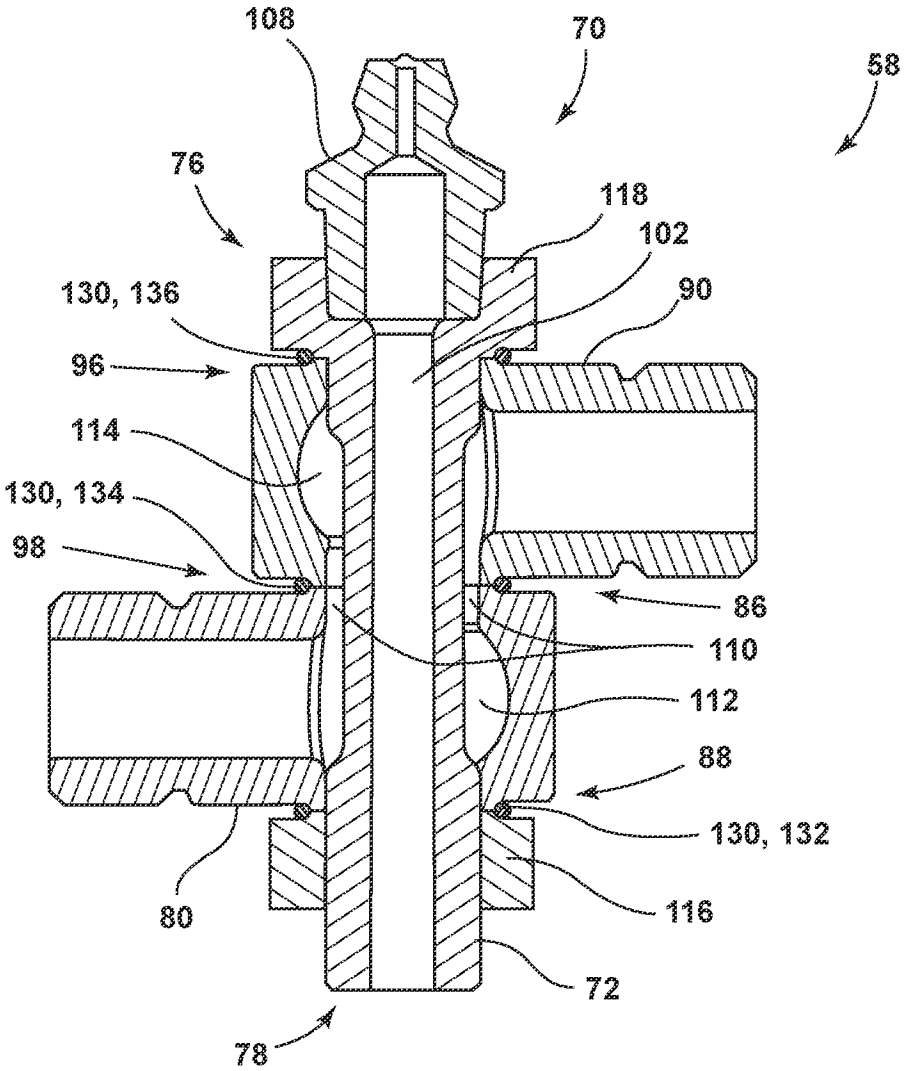
FIG. 3 illustrates a cross-sectional view of the hydraulic fitting assembly taken about Line 3-3 in FIG. 2, particularly illustrating a first housing, a second housing, and a lubrication applicator assembly of the hydraulic fitting assembly.

Referring now to FIG. 3, a cross-sectional view of the hydraulic fitting assembly 58 taken about Line 3-3 in FIG. 2 is illustrated. In particular, FIG. 3 illustrates the first housing 80, the second housing 90, and the lubrication applicator assembly 70.

As mentioned previously, the lubrication applicator assembly 70 is configured to receive a lubricant. As such, the lubrication applicator assembly 70 may define a channel, such as a first channel 102, therein to receive the lubricant. For example, in the illustrated embodiment, the lubrication applicator assembly 70 includes a lubrication applicator sleeve 72 extending from a first end 76 to a second end 78.

The lubrication applicator sleeve 72 may define the first channel 102 therein configured to receive the lubricant. However, as will be described below in reference to FIGS. 4B and 5B, it should be appreciated that the lubrication applicator assembly 70 may define other channels suitable for receiving the lubricant in addition to, or in lieu of, the first channel 102 defined by the lubrication applicator sleeve 72.

Also mentioned previously, the lubrication applicator sleeve 72 may define the first channel 102 configured to receive the lubricant. Furthermore, the first end 76 of the lubrication applicator sleeve 72 may be open such that the lubrication applicator sleeve 72 can receive the lubricant within the first channel 102. Additionally, the second end 78 of the lubrication applicator sleeve 72 may be received within the pivot joint lubrication channel of the second pivot joint 38 (FIGS. 1, 2). The second end 78 of the lubrication applicator sleeve 72 may also be open such that the lubricant may pass from the first channel 102 of the lubrication applicator sleeve 72 through the second end 78 and into the pivot joint lubrication channel of the second pivot joint 38. In this manner, the second pivot joint 38 is lubricated via the lubricant received from the pivot joint lubrication channel.

Moreover, the lubrication applicator assembly 70 may include a lubrication applicator cap 108 coupled to the lubrication applicator sleeve 72 to contain the lubricant within the lubrication applicator assembly 70. For example, in the illustrated embodiment, the lubrication applicator cap 108 is inserted within the first channel 102 at the first end 76 of the lubrication applicator sleeve 72 to prevent lubricant from leaking out of the lubrication applicator sleeve 72. Furthermore, the lubrication applicator cap 108 may be removed from the first channel 102 such that lubricant may be inserted within the first channel 102. However, it should be appreciated that the lubrication applicator cap 108 may be coupled to the lubrication applicator assembly 70 in any other suitable manner.

Additionally, the lubrication applicator assembly 70 may include one or more fasteners coupling the lubrication applicator assembly 70 to the first housing 80 and the second housing 90. For example, as shown in FIG. 3, the lubrication applicator assembly 70 includes a first fastener 116, configured as a first locking nut, coupling the lubrication applicator assembly 70 to the first housing 80. Likewise, as shown in FIG. 3, the lubrication applicator assembly 70 includes a second fastener 118, configured as a second locking nut, coupling the lubrication applicator assembly to the second housing 90. The first fastener 116 and the second fastener 118 are configured to prevent the lubrication applicator assembly 70 from moving relative to the first housing 80 and the second housing 90.

Furthermore, the first housing 80 is configured to receive the lubrication applicator assembly 70 therethrough. As shown in FIG. 3, the first housing 80 extends from a first end 86 to a second end 88 along the second pivot axis 30. The first housing 80 also defines a first housing cavity 112 therein. The first housing cavity 112 may extend from the first end 86 to the second end 88 of the first housing 80. The first end 86 and the second end 88 may each be open such that the lubrication applicator assembly 70, specifically the lubrication applicator sleeve 72, may be received through the first end 86, the second end 88, and the first housing cavity 112. As such, the lubrication applicator assembly 70 is received through the first housing 80.

Likewise, the second housing 90 is configured to receive the lubrication applicator assembly 70 therethrough. As shown in FIG. 3, the second housing 90 extends from a first end 96 to a second end 98 along the second pivot axis 30. The second housing also defines a second housing cavity 114 therein. The second housing cavity 114 may extend from the first end 96 to the second end 98 of the second housing 90. The first end 96 and the second end 98 may each be open such that the lubrication applicator assembly 70, specifically the lubrication applicator sleeve 72, may be received through the first end 96, the second end 98, and the second housing cavity 114. As such, the lubrication applicator assembly 70 is received through the second housing 90.

Furthermore, the first housing 80 and the second housing 90 are rotatably coupled to each other. As shown in FIG. 3, the first housing 80 is coupled to the second housing 90 such that the first housing cavity 112 and the second housing cavity 114 are aligned to simultaneously receive the lubrication applicator assembly 70 therethrough. Furthermore, the first housing 80 is coupled to the second housing 90 such that the hydraulic fluid may be conveyed between the first housing cavity 112 and the second housing cavity 114. For example, as shown in FIG. 3, a width of each of the first housing cavity 112 and the second housing cavity 114 may be greater than a width of the lubrication applicator sleeve 72. As such, one or more fluid flow gaps 110 may be defined between interior walls of each of the first housing 80 and the second housing 90 and an exterior wall of the lubrication applicator sleeve 72. Hydraulic fluid may thus be conveyed between the first housing cavity 112 and the second housing cavity 114 through the fluid flow gap(s) 110.

Moreover, the hydraulic fitting assembly 58 may include one or more seals 130 configured to prevent hydraulic fluid from escaping the hydraulic fitting assembly 58. For example, as shown in FIG. 3, the hydraulic fitting assembly 58 includes a first seal 132, a second seal 134, and a third seal 136, each configured as an O-ring. The first seal 132 is located between the lubrication applicator sleeve 72 and the first housing 80, the second seal 134 is located between the lubrication applicator sleeve 72 and the second housing 90, and the third seal 136 is located between the first housing 80 and the second housing 90.

Figure 4B:
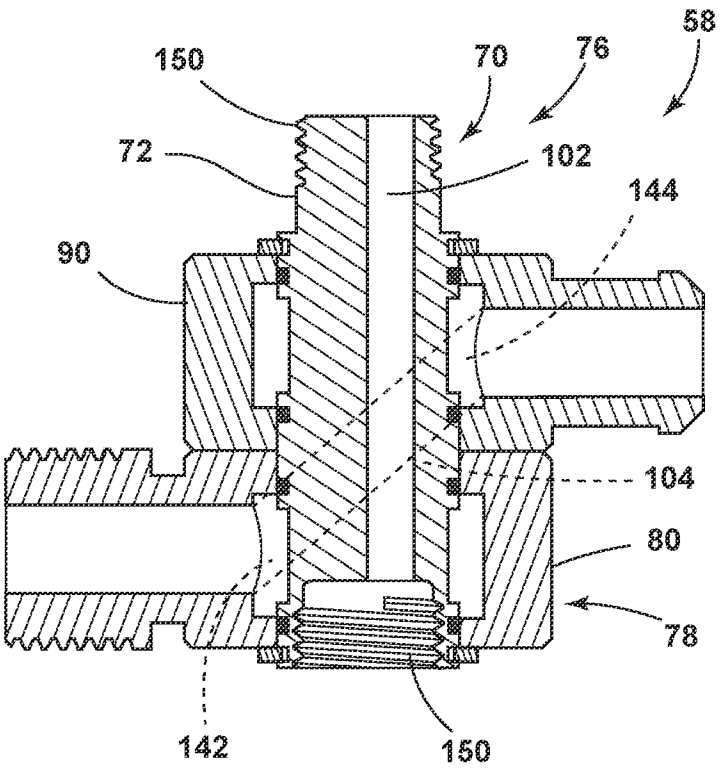
FIG. 4B illustrates a cross-sectional view of the hydraulic fitting assembly of FIG. 4A about Line 4-4.
Figure 4A:
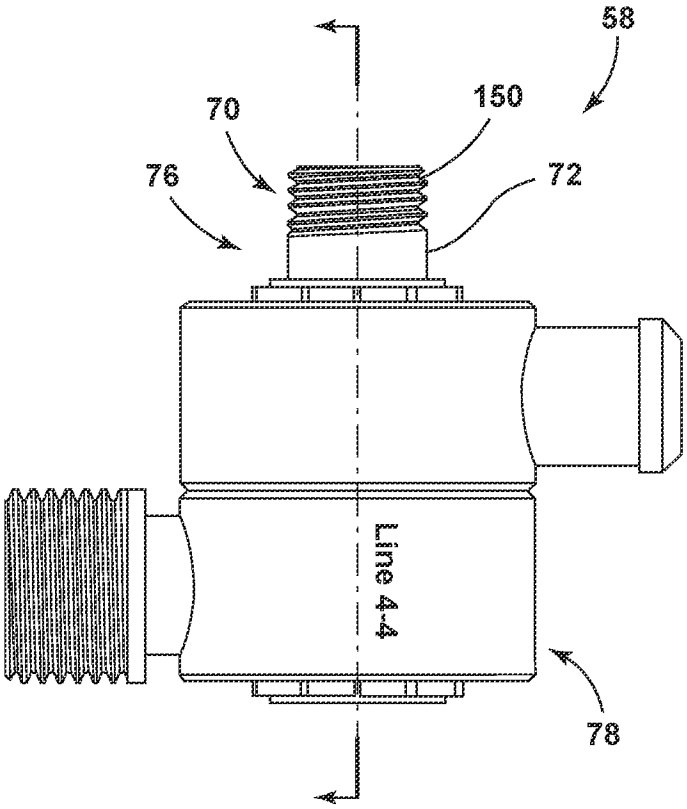
FIG. 4A illustrates a perspective view of another embodiment of a hydraulic fitting assembly for a work vehicle in accordance with aspects of the present subject matter.

Referring now to FIGS. 4A and 4B, differing views of another embodiment of the hydraulic fitting assembly 58 for a work vehicle 10 are illustrated. In particular, FIG. 4A illustrates a perspective view of the additional embodiment of the hydraulic fitting assembly 58. FIG. 4B illustrates a cross-sectional view of the hydraulic fitting assembly 58 of FIG. 4A taken about Line 4-4.

As shown in FIGS. 4A and 4B, the hydraulic fitting assembly 58 is configured similarly to the FIGS. 2 and 3 embodiments of the hydraulic fitting assembly 58. For example, as shown in FIGS. 4A and 4B, the hydraulic fitting assembly 58 includes the first housing 80, the second housing 90, and the lubrication applicator assembly 70. However, unlike the FIGS. 2 and 3 embodiments, in the embodiment as shown in FIG. 4B, the lubrication applicator sleeve 72 of the lubrication applicator assembly 70 of the hydraulic fitting assembly 58 further defines a second channel 104 including an inlet 142 and an outlet 144. The second channel 104 is configured to receive the hydraulic fluid from the first housing 80 through the inlet 142 and discharge the hydraulic fluid into the second housing 90 through the outlet 144.

Furthermore, as shown in FIGS. 4A and 4B, the first end 76 of the lubrication applicator sleeve 72 of the lubrication applicator assembly 70 includes threads 150. In this respect, the lubrication applicator cap 108 can be coupled (e.g., screwed onto/into) to the first end 76 of the lubrication applicator sleeve 72. Additionally, as shown in FIG. 4B, the second end 78 of the lubrication applicator sleeve 72 includes threads 150. In this respect the lubrication applicator sleeve 72 may be coupled to (e.g., threadingly coupled) a pivot joint, such as the second pivot joint 38.

Figure 5B:
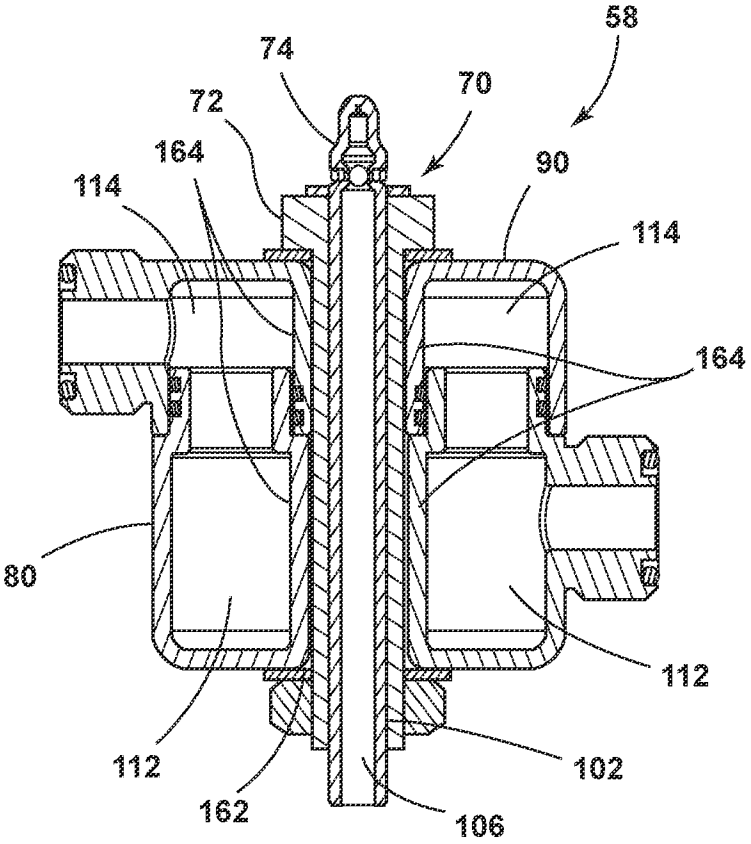
FIG. 5B illustrates a cross-sectional view of the hydraulic fitting assembly of FIG. 5A about Line 5-5.
Figure 5A:
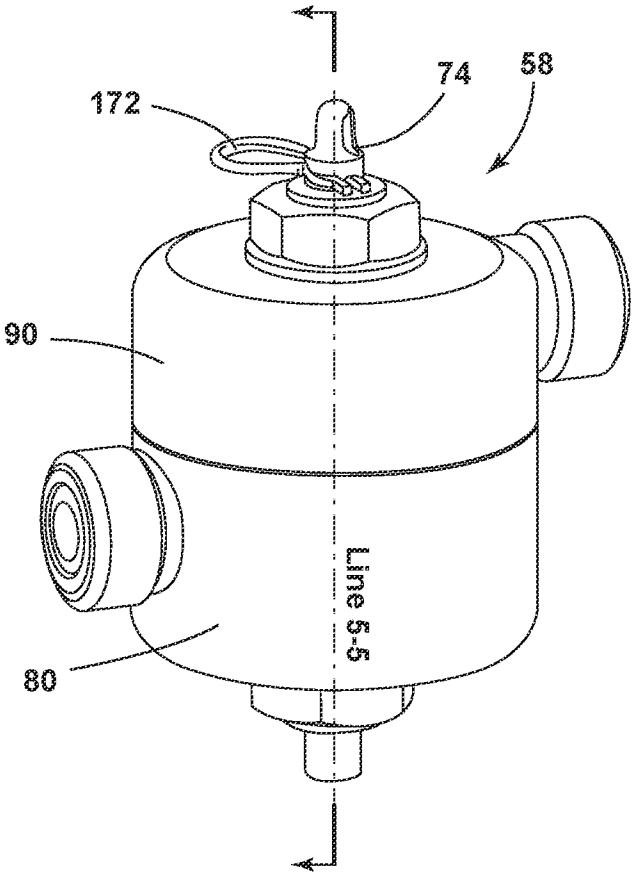
FIG. 5A illustrates a perspective view of a further embodiment of a hydraulic fitting assembly for a work vehicle in accordance with aspects of the present subject matter.

Referring now to FIGS. 5A and 5B, differing views of another embodiment of the hydraulic fitting assembly 58 for a work vehicle 10 are illustrated. In particular, FIG. 5A illustrates a perspective view of the additional embodiment of the hydraulic fitting assembly 58. FIG. 5B illustrates a cross-sectional view of the hydraulic fitting assembly 58 of FIG. 5A taken about Line 5-5.

As shown in FIGS. 5A and 5B, the hydraulic fitting assembly 58 is configured similarly to the FIGS. 2 and 3 embodiments of the hydraulic fitting assembly 58. For example, as shown in FIGS. 5A and 5B, the hydraulic fitting assembly 58 includes the first housing 80, the second housing 90, and the lubrication applicator assembly 70. Unlike the FIGS. 2 and 3 embodiments, as shown in FIG. 5B, the first housing 80 and the second housing 90 further define a lubrication applicator sleeve cavity 162 therein configured to receive the lubrication applicator sleeve 72. Furthermore, the first housing 80 and the second housing 90 each define cavity walls 164 therein. The cavity walls 164 separate the first housing cavity 112 from the lubrication applicator sleeve cavity 162. The cavity walls 164 also separate the second housing cavity 114 from the lubrication applicator sleeve cavity 162. In this respect, the first housing cavity 112 and the second housing cavity 114 are configured to receive the hydraulic fluid therein, but the cavity walls 164 prevent the lubrication applicator sleeve cavity 162 from receiving the hydraulic fluid therein.

Moreover, as shown in FIGS. 5A and 5B, the lubrication applicator assembly 70 further includes a lubrication applicator 74. The lubrication applicator 74 may be configured as a lubrication pin. The lubrication applicator 74 defines a third channel 106 therein configured to receive the lubricant. Additionally, as shown in FIG. 5B, the first channel 102 defined within the lubrication applicator sleeve 72 receives the lubrication applicator 74 therein. Furthermore, as shown in FIG. 5A, a coupling pin 172 is coupled to the lubrication applicator 74 and is configured to prevent the lubrication applicator 74 from moving relative to the lubrication applicator sleeve 72.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

The invention claimed is:

1. A work vehicle, comprising:

a first arm;

a second arm pivotably coupled to the first arm; and a hydraulic fitting assembly coupled between the first arm and the second arm at a pivot joint, the hydraulic fitting assembly comprising:

a first housing, the first housing including a first tube fitting coupled thereto, the first housing defining a cavity configured to receive a hydraulic fluid therein, the first housing being configured to rotate relative to a second housing when at least one of the first arm or the second arm is pivoted;

the second housing, the second housing including a second tube fitting coupled thereto, the second housing rotatably coupled to the first housing such that the second housing is configured to rotate relative to the first housing when at least one of the first arm or the second arm is pivoted, the second housing defining a cavity configured to receive the hydraulic fluid therein, the cavity of the second housing is aligned with the cavity of the first housing; and a lubrication applicator assembly at least partially positioned within the cavity of the first housing and the cavity of the second housing, the lubrication applicator assembly defining a channel therein configured to receive a lubricant, wherein the hydraulic fitting assembly is configured to lubricate the pivot joint.

2. The work vehicle of claim 1, wherein:

the first tube fitting corresponds to an inlet configured to receive the hydraulic fluid therein; and the second tube fitting corresponds to an outlet configured to discharge the hydraulic fluid therefrom.

3. The work vehicle of claim 1, further comprising:

a first hydraulic tube coupled to the first tube fitting of the hydraulic fitting assembly and configured to convey the hydraulic fluid between the first hydraulic tube and the cavity of the first housing; and a second hydraulic tube coupled to the second tube fitting of the hydraulic fitting assembly and configured to convey the hydraulic fluid between the second hydraulic tube and the cavity of the second housing.

4. The work vehicle of claim 3, wherein:

the pivot joint to which the hydraulic fitting assembly is coupled corresponds to a second pivot joint;

the first hydraulic tube is fixed relative to the first arm such that the first hydraulic tube rotates with the first housing and the first arm when the first arm is pivoted relative to the second arm; and the second hydraulic tube is fixed relative to the second arm such that the second hydraulic tube rotates with the second housing and the second arm when the second arm is pivoted relative to the first arm.

5. The work vehicle of claim 1, wherein the cavity of the first housing is fluidly coupled to the cavity of the second housing.

6. The work vehicle of claim 1, wherein the channel of the lubrication applicator assembly corresponds to a first channel, the lubrication applicator assembly further defining:

a second channel including an inlet configured to receive the hydraulic fluid from the first housing and an outlet configured to discharge the hydraulic fluid into the second housing.

7. The work vehicle of claim 1, the lubrication applicator assembly further comprising:

a first fastener coupling the lubrication applicator assembly to the first housing; and a second fastener coupling the lubrication applicator assembly to the second housing, wherein the first fastener and the second fastener are configured to prevent the lubrication applicator assembly from moving relative to the first housing and the second housing.

8. The work vehicle of claim 1, the lubrication applicator assembly further comprising:

a lubrication applicator;

a lubrication applicator sleeve configured to receive the lubrication applicator therethrough;

a first fastener coupling the lubrication applicator sleeve to the first housing; and a second fastener coupling the lubrication applicator sleeve to the second housing.

9. A system for lubricating a pivot joint of a work vehicle, the system comprising:

a first arm;

a second arm pivotably coupled to the first arm; and a hydraulic fitting assembly coupled between the first arm and the second arm at a pivot joint, the hydraulic fitting assembly comprising:

a first housing, the first housing including a first tube fitting coupled thereto, the first housing defining a cavity configured to receive a hydraulic fluid therein, the first housing being configured to rotate relative to a second housing when at least one of the first arm or the second arm is pivoted;

the second housing, the second housing including a second tube fitting coupled thereto, the second housing rotatably coupled to the first housing such that the second housing is configured to rotate relative to the first housing when at least one of the first arm or the second arm is pivoted, the second housing defining a cavity configured to receive the hydraulic fluid therein, the cavity of the second housing is aligned with the cavity of the first housing; and a lubrication applicator assembly at least partially positioned within the cavity of the first housing and the cavity of the second housing, the lubrication applicator assembly defining a channel therein configured to receive a lubricant, wherein the hydraulic fitting assembly is configured to lubricate the pivot joint.

10. The system of claim 9, wherein:

the first tube fitting corresponds to an inlet configured to receive the hydraulic fluid therein; and the second tube fitting corresponds to an outlet configured to discharge the hydraulic fluid therefrom.

11. The system of claim 9, further comprising:

a first hydraulic tube coupled to the first tube fitting of the hydraulic fitting assembly and configured to convey the hydraulic fluid between the first hydraulic tube and the cavity of the first housing; and a second hydraulic tube coupled to the second tube fitting of the hydraulic fitting assembly and configured to convey the hydraulic fluid between the second hydraulic tube and the cavity of the second housing.

12. The system of claim 11, wherein:

the pivot joint to which the hydraulic fitting assembly is coupled corresponds to a second pivot joint;

the first hydraulic tube is fixed relative to the first arm such that the first hydraulic tube rotates with the first housing and the first arm when the first arm is pivoted relative to the second arm; and the second hydraulic tube is fixed relative to the second arm such that the second hydraulic tube rotates with the second housing and the second arm when the second arm is pivoted relative to the first arm.

13. The system of claim 9, wherein the channel of the lubrication applicator assembly corresponds to a first channel, the lubrication applicator assembly further defining:

a second channel including an inlet configured to receive the hydraulic fluid from the first housing, and an outlet configured to discharge the hydraulic fluid into the second housing.

14. A construction vehicle, comprising:

a frame;

a lift arm assembly comprising:

a first arm pivotably coupled to the frame at a first pivot joint; and a second arm pivotably coupled to the first arm at a second pivot joint; and a hydraulic fitting assembly coupled to the second pivot joint, the hydraulic fitting assembly comprising:

a first housing, the first housing including a first tube fitting coupled thereto, the first housing defining a cavity configured to receive a hydraulic fluid therein, the first housing being configured to rotate relative to a second housing when at least one of the first arm or the second arm is pivoted;

the second housing, the second housing including a second tube fitting coupled thereto, the second housing rotatably coupled to the first housing such that the second housing is configured to rotate relative to the first housing when at least one of the first arm or the second arm is pivoted, the second housing defining a cavity configured to receive the hydraulic fluid therein, the cavity of the second housing is aligned with the cavity of the first housing; and a lubrication applicator assembly at least partially positioned within the cavity of the first housing and the cavity of the second housing, the lubrication applicator assembly defining a channel therein configured to receive a lubricant, wherein the hydraulic fitting assembly is configured to lubricate the second pivot joint.

15. The construction vehicle of claim 14, wherein:

the first tube fitting corresponds to an inlet configured to receive the hydraulic fluid therein; and the second tube fitting corresponds to an outlet configured to discharge the hydraulic fluid therefrom.

16. The construction vehicle of claim 14, wherein:

a first hydraulic tube coupled to the first tube fitting of the hydraulic fitting assembly and configured to convey the hydraulic fluid between the first hydraulic tube and the cavity of the first housing; and a second hydraulic tube coupled to the second tube fitting of the hydraulic fitting assembly and configured to convey the hydraulic fluid between the second hydraulic tube and the cavity of the second housing.

17. The construction vehicle of claim 16, wherein:

the first hydraulic tube is fixed relative to the first arm such that the first hydraulic tube rotates with the first housing and the first arm when the first arm is pivoted relative to the second arm; and the second hydraulic tube is fixed relative to the second arm such that the second hydraulic tube rotates with the second housing and the second arm when the second arm is pivoted relative to the first arm.

* * * * *